US005643114A

United States Patent [19]

Marcus

[11] Patent Number: 5,643,114

[45] Date of Patent: Jul. 1, 1997

[54] GOLF ACCESSORY

[75] Inventor: Ira Marcus, Fort Lauderdale, Fla.

[73] Assignee: Jenny Wyatt Enterprises, Inc., Fort Lauderdale, Fla.

[21] Appl. No.: 714,795

[22] Filed: Sep. 13, 1996

[51] Int. Cl.[6] ..... A63B 57/00

[52] U.S. Cl. ..... 473/408; 131/248

[58] Field of Search ..... 473/408, 406, 473/405, 387, 286, 285, 284; D21/234; 131/248, 250, 187

[56] References Cited

U.S. PATENT DOCUMENTS

| | | | |
|---|---|---|---|
| D. 300,160 | 3/1989 | Johnson . | |
| 3,001,529 | 9/1961 | Watson | 473/387 |
| 4,063,731 | 12/1977 | Kitay | 473/286 |
| 4,627,621 | 12/1986 | Tate . | |
| 4,838,285 | 6/1989 | Petrone | 473/387 |
| 5,030,721 | 7/1991 | Bowen et al. | 131/248 |
| 5,305,999 | 4/1994 | Tate . | |
| 5,388,824 | 2/1995 | Reimers | 473/406 |
| 5,401,019 | 3/1995 | Wissman et al. . | |

*Primary Examiner*—Steven B. Wong
*Attorney, Agent, or Firm*—Larson & Taylor

[57] ABSTRACT

A golf accessory which is a combined ball-mark repairer and cigar cutter and/or holder is disclosed. In a first embodiment the device includes a ball mark repairer at one end and a cigar cutter located at the other end. The device includes a sliding mechanism whereby the cigar cutter can be actuated by pulling on one end of the device while holding the other end of the device firmly. The device may optionally include projections for firmly embedding the device in the ground to provide a cigar holder for a golfer and may optionally include a ball marker as well associated magnetically with the golf accessory.

19 Claims, 3 Drawing Sheets

GOLF ACCESSORY

BACKGROUND OF THE INVENTION

1. Field of the Invention

The present invention relates to an improved golf accessory which can be utilized as a ball-mark repairer as well as a cigar cutter and/or holder for use during a golf round.

2. Description of the Prior Art

A variety of golf accessories have been in existence for a number of years. For example, U.S. Pat. No. 3,001,529 discloses a golf smoke tee which is designed to be inserted into the ground and to hold cigars or cigarettes. Although a number of different embodiments are disclosed, this device has no golf-related utility other than to provide a cigarette holder which can be inserted into the ground as necessary.

U.S. Pat. No. 4,063,731 (Kitay) discloses a multi-purpose golfer's tool. The tool provides a distance estimating facility, a divot tool and a dry-dub grip support in addition to a cleat wrench, cleat cleaner and club-groove cleaner. The device also includes a tee-height gauge and a cigarette holder.

U.S. Pat. No. 4,838,285 (Petrone) discloses a golf tee having a substantially V-shaped groove for receiving and holding cigarettes, cigars or the handle of a golf club. The tee is inserted into the ground in the normal way and is used for supporting cigarettes, cigars or the handle of a golf club a distance above the ground so that such objects do not come in contact with dangerous chemicals which may be used on the grass of golf courses.

U.S. Pat. No. 4,627,621 (Tate) discloses a golf accessory which serves both as a divot tool and as a money clip. The clip can be used as a means of attachment of the accessory to the belt, cap, shoe or golf bag of a golfer in addition to being useful as a money clip. The accessory also includes a looped return beyond a disk-shaped body which defines a saddle facing upwardly. The saddle serves as a stand or prop for supporting the grip of a golf club above the grass in order to prevent the grip from becoming wet with moisture which may be on the turf.

U.S. Pat. No. 5,305,999 (Tate) also discloses a golf accessory which includes a projection in the top of which a transverse groove is defined. The transverse groove is of a size suitable for cradling a cigarette. The projection may be formed as a return bent back in a loop in order to form a clip for money, bills, or other papers. The backing plate may also be provided with recessed regions in which magnets may be mounted to receive disk-shaped ball markers. The device also includes a structure which may be used to clean the grooves in the face of a golf club.

U.S. Pat. No. 5,401,019 (Wissman et al) discloses a golf tool having a variety of uses. The tool includes a circular hole for checking the roundness of a golf ball which hole can also be used in the form of a ball retriever by fastening the tool to the end of a golf club. The tool includes two fingers for cleaning the grooves on the face of golf club heads or to repair ball-marks on golf course greens. The tool can also be struck into the ground in an upright position such that a flattened portion on the top of the tool can be used to keep the handgrip of a golf club off wet grass. A slot on the tool may be used to hold a cigarette when the tool is struck in the ground in such an upright position.

U.S. Design Pat. No. 300,160 (Johnson) discloses an ornamental design for a combined golfers green repairer, shoehorn, cleat tightener and cleaner, and golf club and cigarette rest.

While all of these golf accessories are useful for one purpose or another, there is still a need in the art for other types of golf accessories.

It is accordingly an object of the present invention to provide a novel golf accessory which can be used to repair ball-marks, tighten cleats, clean cleats, hold cigars, provide one or more ball-markers and/or to cut the end off of a cigar prior to smoking. These and other objects of the present invention will be apparent from the summary and detailed descriptions which follow.

SUMMARY OF THE INVENTION

In its broadest sense, the present invention relates to a golf accessory which includes a ball-mark repairer and a cigar cutter. The golf accessory is made up of a body having an upper surface, a lower surface and a peripheral edge, a pair of elongate, generally parallel legs extending from a section of the peripheral edge of the body, and a cigar cutter built into the body.

In a second embodiment, the golf accessory includes a ball-mark repairer, a cigar hallder and a cigar cutter. In this embodiment, the golf accessory is formed from a guide section and a slide which together include the structure required to provide a cigar cutter in the golf accessory.

The golf accessory may also optionally include a magnetic ballmarker, if desired. Further, the device may include one or more projections extending from the lower surface of the golf accessory which can be used to securely insert the golf accessory in the ground with the cigar holder properly oriented to hold a lit cigar above the level of the grass on the golf course. Several embodiments of the invention will be described in greater detail by reference to the accompanying drawings.

DETAILED DESCRIPTION OF THE PREFERRED EMBODIMENTS

Referring to the figures, like elements are represented by like numerals throughout the several views.

Drawing FIGS. 1–5 all illustrate one embodiment of a golf accessory 1 of the present invention which may be utilized as at least a ball-mark repairer, cigar holder and cigar cutter. The golf accessory 1 is preferably fabricated from metal although it may also be fabricated from plastic or other materials.

Figure 1:
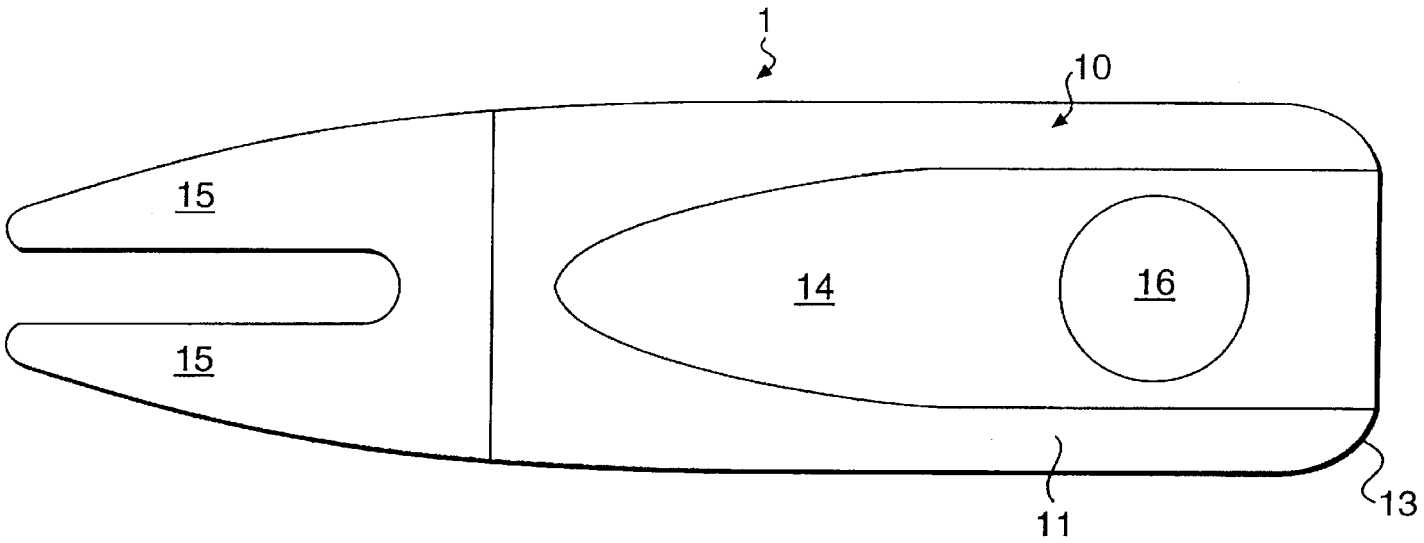
FIG. 1 is a top elevational view of the upper surface of one embodiment of the golf accessory of the invention.

Referring to FIG. 1 there is shown a golf accessory 1 having a body 10 which has an upper surface 11, a lower surface 12 (shown in FIG. 2) and a peripheral edge 13. Body 10 includes a concave cradle 14 in upper surface 11 thereof. Concave cradle 14 is positioned adjacent peripheral edge 13 on one end and is spaced some distance from peripheral edge 13 on the other end of body 10. Concave cradle 14 is shaped to receive and support a lit cigar so that the golf accessory 1 can function as a cigar holder when positioned with concave cradle 14 in the upright position.

A pair of elongate, generally parallel legs 15 extend from body 10 as shown in FIG. 1. Parallel legs 15 are used for repairing ball-marks on golf greens. Further, parallel legs 15 may also be employed for cleaning the spikes on the bottom of golf shoes and can be used for tightening and/or loosening .spikes if the parallel legs 15 are properly spaced from one another for this purpose.

Body 10 of golf accessory 1 may optionally include a cigar cutter. Part of the cigar cutter is formed by a circular hole 16 which is adapted to receive the butt end of a cigar. The cigar cutter may be actuated in any suitable manner known to those of ordinary skill in the art. One embodiment of the cigar cutter will be described in greater detail with reference to FIGS. 3–5 and another embodiment is shown in FIG. 6.

Figure 2:
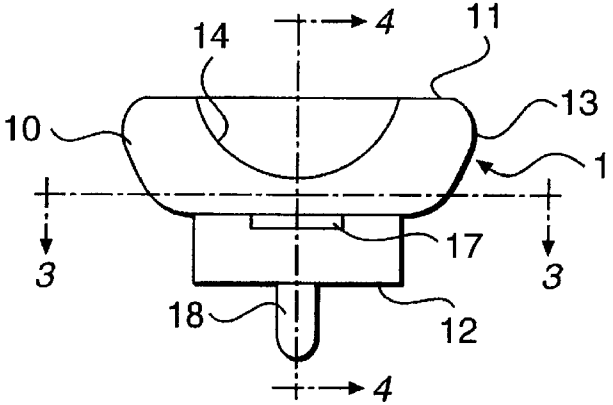
FIG. 2 is a right side elevational view of the golf accessory shown in FIG. 1.

Referring now to FIG. 2, there is a shown a perspective view of the end of the golf accessory 1 away from the parallel legs 15. As shown in FIG. 2, the golf accessory may include an optional projection 18 attached to the lower surface 12 of body 10. Projection 18 serves to anchor golf accessory 1 in the ground when the golfer sets it down to use as a cigar holder. As can be seen from FIG. 2 when projection 18 is embedded in the grass, concave cradle 14 will be positioned to receive and support a lit cigar.

Also shown in FIG. 2 is an optional ball-marker 17 which may be attached magnetically or by any other suitable means to golf accessory 1. In one embodiment, ball-marker 17 is formed from a metallic material and body 10 includes a magnetic portion in the vicinity of ball-marker 17 which serves to attract bill-marker 17 thereto and securely hold it in position when not in use. In the preferred embodiment, body 10 is formed from a suitable metal material and ball-marker 17 is magnetized in order to secure ball-marker 17 to body 10 when not in use.

Figure 3:
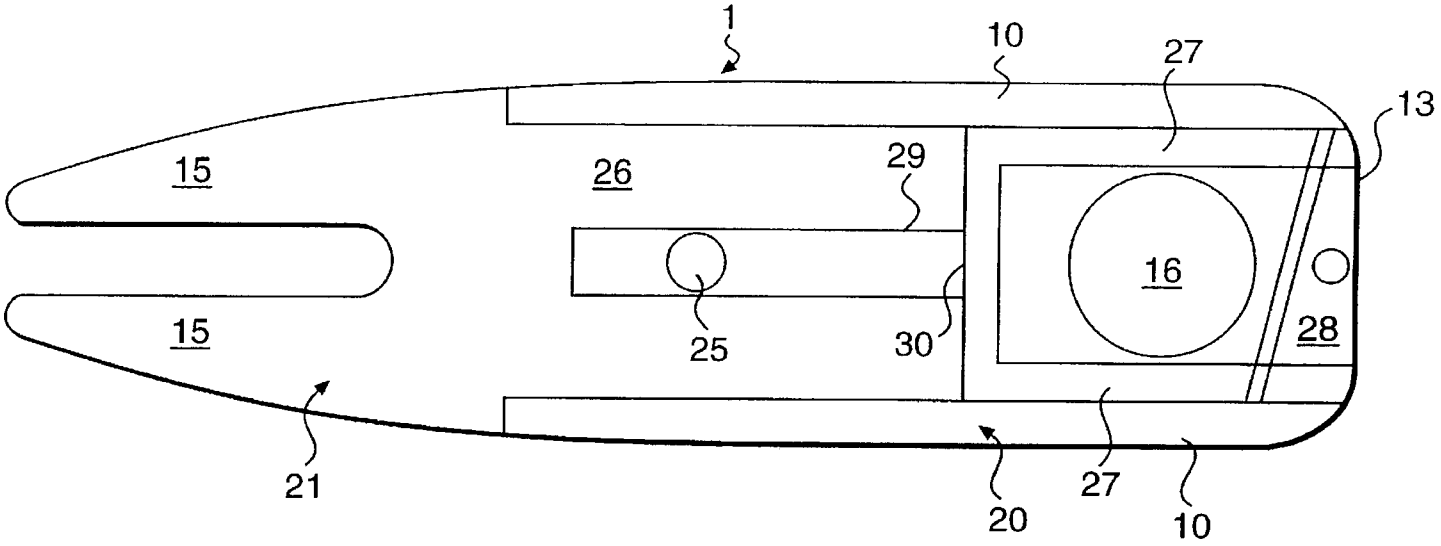
FIG. 3 is a cross-sectional view of the golf accessory of FIG. 2 taken along the line 3—3.
Figure 4:
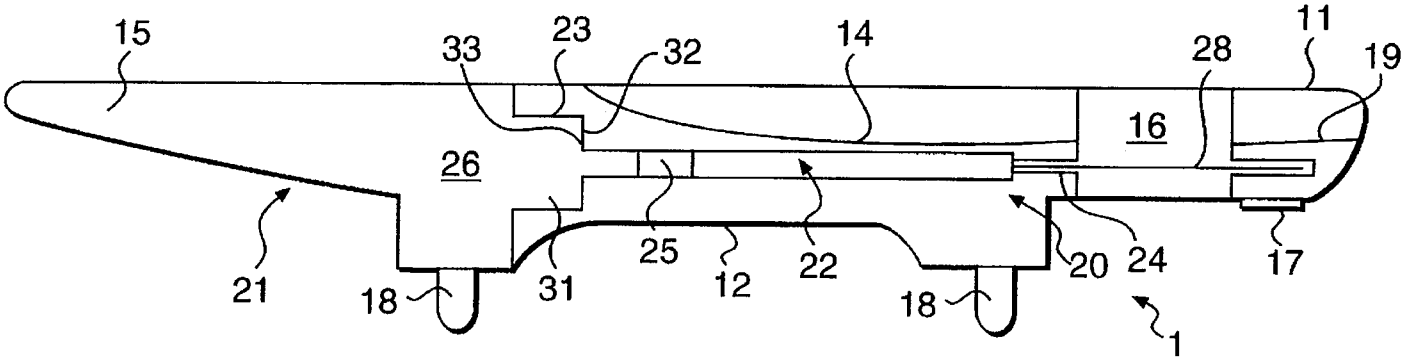
FIG. 4 is a cross-sectional view of the golf accessory of FIG. 2 taken along the line 4—4 in the compressed position.
Figure 5:
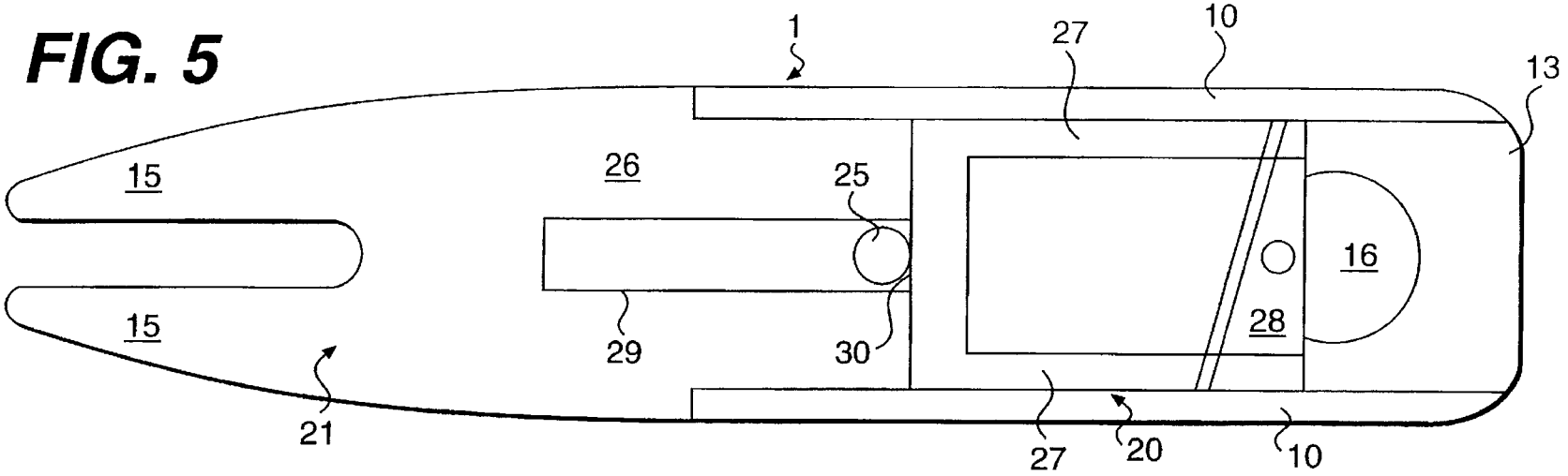
FIG. 5 is a cross-sectional view of the golf accessory of FIG. 2 taken along the line 4—4 in the expanded position.
Figure 6:
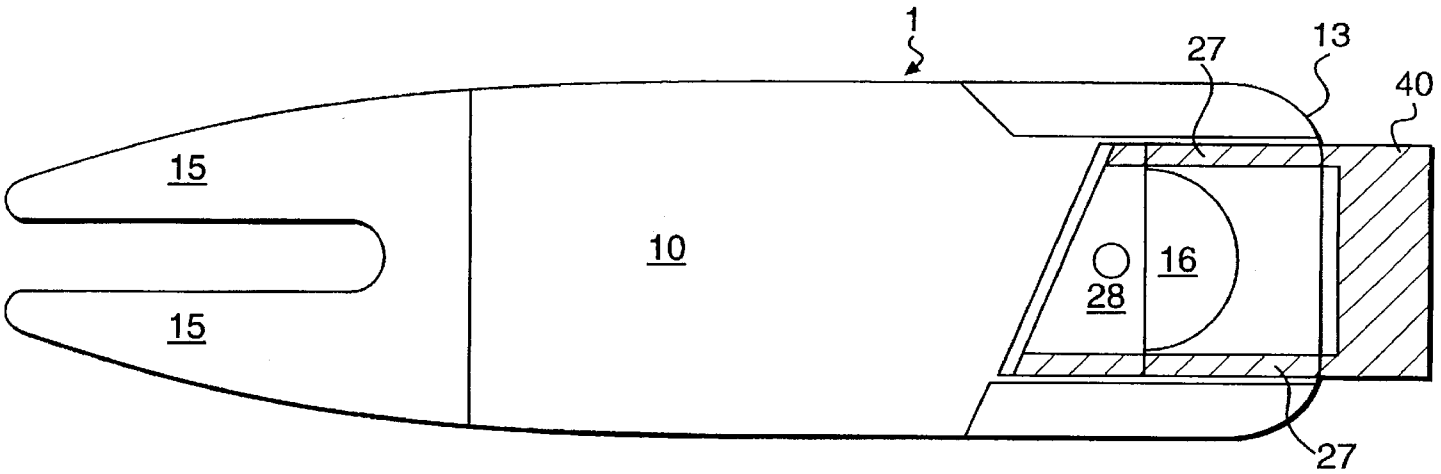
FIG. 6 is a cross-sectional view of an alternative embodiment of a golf accessory in accordance with the present invention.

FIGS. 3–5 show the inner workings of the cigar cutter of the invention. More particularly, the golf accessory 1 of the present invention is divided into two parts, a guide section 20 and a slide 21. Guide section 20 is formed from the body 10 and thus includes all of the upper surface 11, lower surface 12, peripheral edge 13, concave cradle 14 and circular hole 16 therein. In addition, guide section 20 is shaped to define a slot 22 which includes a wide portion 23 and a narrow blade slot 24.

Slide 21 is formed from a combination of slide body 26 and legs 15. Attached to slide body 26 are parallel arms 27 which extend around circular hole 16 of guide section 20. Parallel arms 27 have at their distal ends a cutting blade 28 attached thereto as shown in FIG. 3.

Slide 21 is adapted for a sliding motion in slot 22 of guide section 20. Thus, the cross-sectional view shown in FIG. 3 depicts the cigar cutter in the first, compressed position. The first, compressed position is the preferred rest position of the device and is the position wherein the cigar butt is inserted into circular hole 16 prior to cutting. Once a cigar butt is inserted into circular hole 16, the cigar cutter may be actuated by grasping guide section 20 with one hand and slide 21 with the other hand. Then, slide 21 is pulled while holding guide section 20 firmly until the cigar cutter reaches the second expanded position as shown in FIG. 5 at which point the blade 28 has traversed the entire area of circular hole 16 whereby the butt end of the cigar is cut off by cutting blade 28.

Movement of slide 21 relative to guide section 20 is limited in one direction by blade stop 25 which is located on the guide section 20 so that it fits in an elongate slot 29 provided in slide body 26 such that slide 21 can move relative to blade stop 25 to its fully extended position without interference due to elongate slot 29. When the device reaches the second, extended position surface 30 of slide body 26 abuts with blade stop 25 in order to prevent further lateral movement of slide 21 relative to guide section 20.

Similarly, when slide 21 reaches the first, compressed position shown in FIG. 3, further movement of slide 21 relative to guide section 20 is prevented by abutment of the peripheral lip 33 formed by wide portion 31 of slide body 26 against annular shoulder 32 of guide section 20. Annular shoulder 32 is formed at the transition between the wide portion 23 of slot 22 to the more narrow central portion of slot 22 as shown in FIG. 4. In a more preferred embodiment, wide portion 23 of slot 22 and wide portion 31 of slide 21 are formed with relative sizes such that an interference fit is created between the respective wide portions 23 and 31 when the golf accessory 1 is in the first, compressed position. In this manner, the golf accessory 1 will remain in this position until the user pulls on slide 21 with sufficient force to overcome the frictional interference fit between slide 21 and guide section 20.

In a preferred embodiment, golf accessory 1 includes two projections 18 as shown in FIG. 4, one attached to guide section 20 and the other attached to slide 21 such that golf accessory 1 can be firmly affixed in the ground with concave cradle 14 facing upwardly in order to receive and hold a lit cigar.

Referring now to FIG. 6 there is shown an alternative embodiment of the golf accessory 1 of the present invention. The primary difference between this embodiment and the embodiment depicted in FIGS. 1–5 is that this embodiment employs a different means for actuating the cutting blade 28 of the cigar cutter.

In this embodiment, cutting blade 28 is actuated by handle 40 via its attachment to parallel arms 27. In the rest position of this embodiment as shown in FIG. 6, handle 40 is located directly adjacent body 10 of golf accessory 1 and cutting blade 28 is positioned over circular hole 16 as shown in the figure. Thus, to use the cigar cutter of this embodiment, the user must pull on handle 40 to move cutting blade 28 to a position to the right of circular hole 16, insert the butt end of a cigar in circular hole 16 and then push handle 40 back to the left (as shown in FIG. 6). Again, parallel arms 27 and cutting blade 28 are located in a slot (not shown) in body 10 of golf accessory 1.

Other suitable means for actuating the cutting blade 28 are contemplated as being within the scope of the present invention. For example, the cigar cutter can be actuated by pulling on a portion of the device connected to the blade 28 in order to cause blade 28 to traverse circular hole 16 in a manner similar to that shown in FIGS. 3–5. Alternatively, the cigar cutter can be actuated by pulling on a portion of the device which is connected to blade 28 in order to cause blade 28 to traverse circular hole 16 in a manner similar to that shown in FIG. 6. A third means for actuating the cigar cutter is a lever (not shown) which can be attached to the blade 28 in a manner whereby sliding the lever to one side will cause the blade to traverse circular hole 16. Although these three general types of apparatus are preferred for actuating the cigar cutter, other suitable means may be employed.

The foregoing summary and detailed description has been presented for the purpose of illustration and description only and is not to be construed as limiting the invention in any way. The scope of the invention is to be determined from the claims appended hereto.

I claim:

1. A golf accessory which includes a ball-mark repairer and cigar cutter which comprises:

a body having an upper surface, a lower surface and a peripheral edge;

a pair of elongate, generally parallel legs extending from a section of the peripheral edge of the body;

a generally circular hole extending through the body from the upper surface to the lower surface, the hole being sufficiently large to receive the butt end of a cigar; and a cutting blade slidably mounted in the body such that the blade can be slidably moved across said generally circular hole for cutting the end of a cigar inserted in said hole and a means for actuating said cutting blade for sliding movement across said generally circular hole to cut off the end of a cigar.

2. A golf accessory as claimed in claim 1 further comprising a concave cradle formed in the upper surface of the body and extending from a position on the upper surface adjacent to the peripheral edge located opposite the section of the peripheral edge from which the pair of legs extends to a position spaced from the peripheral edge from which the pair of legs extend, said concave cradle being of sufficient size to receive and support a cigar.

3. A golf accessory as claimed in claim 1 which further comprises a blade stop affixed to the body and positioned to limit the extent of the sliding movement of the cutting blade.

4. A golf accessory as claimed in claim 1 further comprising one or more projections which project outwardly from the lower surface of the body.

5. A golf accessory as claimed in claim 4 wherein a portion of the lower surface of the body is made from metal and further comprising a flat ball marker formed from a magnetic material associated with said metal portion of the lower surface of the body.

6. A golf accessory as claimed in claim 4 wherein the lower surface of the body includes a magnetic region and which further comprises a flat ball marker which includes sufficient metal to be magnetically releasably attached to the magnetic region of the lower surface.

7. A golf accessory as claimed in claim 1 wherein the actuating means for the cigar cutter comprises a slide.

8. A golf accessory as claimed in claim 1 wherein the actuating means for the cigar cutter comprises a handle.

9. A golf accessory which includes a ball-mark repairer and a cigar cutter which comprises:

a guide section having an upper surface, a lower surface, a peripheral edge, a generally circular hole which passes through said guide section from said upper surface to said lower surface and is of sufficient size to receive the butt end of a cigar, and a slot located in a peripheral edge of the guide section and extending through said guide section up to and beyond said circular hole, and a slide which includes a slide body having first and second ends, the first end of which is adapted to fit and slide in the slot in the guide section from a first, contracted position to a second, extended position; a pair of elongate, generally parallel arms extending from the first end of the slide body, each of said arms having a distal end; a blade mounted between the distal ends of the parallel arms, the arms and blade being positioned such that when the slide is in the contracted position, the arms and blade surround the hole in the guide section and during movement of the slide from the contracted position to the expanded position the blade traverses the circular hole; and a pair of elongate, generally parallel legs extending from the second end of said slide body.

10. A golf accessory as claimed in claim 9 wherein said guide section further comprises a blade stop extending into the slot in the guide section and said slide further comprises an elongate hole having a peripheral edge and being sufficiently wide to permit the blade stop to pass through the hole, and the hole being of sufficient length to permit the slide to slide from the first contracted position to the second extended position where the peripheral edge of the elongate hole abuts with the blade stop to prevent movement of the slide beyond the extended position.

11. A golf accessory as claimed in claim 10 wherein the slide body includes a wide portion and a narrow portion, the transition between the wide portion and the narrow portion forming a peripheral lip about the narrow portion of the slide body, and the slot in the guide section comprises a wide portion which is located adjacent the peripheral edge of the guide section and a narrow portion spaced from the peripheral edge whereby the narrowing of the slot from the wide portion to the narrow portion forms an annular shoulder around the narrow portion of the slot, the wide portion of the slot being adapted to receive the corresponding wide portion of the slide body such that when the slide is in the first, compressed position the peripheral lip of the slide body abuts against the annular shoulder around the narrow portion of the slot in the guide section to thereby prevent movement of the slide beyond the fully contracted position.

12. A golf accessory as claimed in claim 11 wherein the wide portion of the slide body is adapted for an interference fit in the wide portion of the slot in the guide section when the slide is in the first, compressed position.

13. A golf accessory as claimed in claim 10 wherein the guide section further comprises a concave cradle formed in the upper surface adjacent to the peripheral edge of the guide section which is opposite the peripheral edge of the guide section in which the slot is located.

14. A golf accessory as claimed in claim 13 wherein the circular hole in the guide section is located within the concave cradle.

15. A golf accessory as claimed in claim 10 further comprising at least one projection which extends outwardly from the lower surface of the guide section.

16. A golf accessory as claimed in claim 15 wherein the slide body has a lower surface which extends beyond the slot in the guide section when the slide is in the first, compressed position and wherein the slide further comprises at least one projection which extends outwardly from the lower surface of the slide body.

17. A golf accessory as claimed in claim 10 wherein the slide body has a lower surface which extends beyond the slot in the guide section when the slide is in the first, compressed position and wherein the slide further comprises at least one projection which extends outwardly from the lower surface of the slide body.

18. A golf accessory as claimed in claim 10 wherein a portion of the lower surface of the guide section is made from metal and further comprising a flat ball marker formed from a magnetized material associated with said metal portion of the lower surface of said guide section.

19. A golf accessory as claimed in claim 10 wherein the lower surface of said guide section includes a magnetic region and which further comprises a flat ball marker which includes sufficient metal to be magnetically releasably attached to the magnetic region of the lower surface of the guide section.

* * * * *